United States Patent [19]

Gitzendanner et al.

[11] 4,096,463

[45] Jun. 20, 1978

[54] INDUCTIVE TRANSDUCER

[75] Inventors: Louis G. Gitzendanner, Pleasanton; Francis V. Thiemann, San Jose, both of Calif.

[73] Assignee: Xerox Corporation, Stamford, Conn.

[21] Appl. No.: 747,116

[22] Filed: Dec. 2, 1976

[51] Int. Cl.[2] ..... H01F 21/04

[52] U.S. Cl. ..... 336/129

[58] Field of Search ..... 336/123, 129, 115, 122, 336/69, 70, 200

[56] References Cited

U.S. PATENT DOCUMENTS

| | | | |
|---|---|---|---|
| 2,685,070 | 7/1954 | Childs | 336/123 |
| 2,867,783 | 1/1959 | Childs | 336/123 |
| 2,900,612 | 8/1959 | Tripp | 336/123 |
| 2,915,721 | 12/1959 | Farrand et al. | 336/129 |
| 2,924,798 | 2/1960 | Foster | 336/129 X |
| 3,064,218 | 11/1962 | Farrand | 336/129 |
| 3,441,888 | 4/1969 | Ferrand | 336/123 |
| 3,668,587 | 6/1972 | Foster | 336/129 X |
| 3,732,513 | 5/1973 | Farrand | 336/129 |
| 3,772,587 | 11/1973 | Ferrand et al. | 336/129 X |
| 3,882,437 | 5/1975 | Geller | 336/123 |

*Primary Examiner*—Thomas J. Kozma
*Attorney, Agent, or Firm*—Barry Paul Smith

[57] ABSTRACT

An inductive transducer includes first and second relatively movable members, the first relatively movable member having a plurality of windings and the second relatively movable member having a winding. The windings of the first relatively movable member each have a pair of terminals and are each arranged in a pattern comprised of a first section coupled to one of the terminals and a second section coupled to the other terminal and to the first section. Each section includes a plurality of conductors oriented substantially parallel to one another wherein immediately adjacent conductors of such section are capable of conducting current in opposite directions and are coupled to one another by an end-segment arranged substantially perpendicular to the conductors. Each end-segment of the first section is spaced closely adjacent and substantially parallel to an end-segment of the second section, and each conductor of the first section is spaced closely adjacent and substantially parallel to a conductor of the second section adapted to conduct current in the opposite direction as such conductor of the first section. The winding of the second relatively movable member is similar, except its first section has alternate end-segments thereof spaced closely adjacent and substantially parallel to alternate end-segments of its second section, and each conductor of its first section is substantially aligned longitudinally with a conductor of its second section adapted to conduct current in the same direction as such conductor of its first section.

14 Claims, 3 Drawing Figures

INDUCTIVE TRANSDUCER

BACKGROUND OF THE INVENTION

This invention relates to transducers and, more particularly, to an inductive transducer of the type comprising first and second relatively movable members, the first relatively movable member having a plurality of windings and the second relatively movable member having a winding.

Inductive transducers of the above-type have been known for many years, as exemplified by U.S. Pat. Nos. 2,799,835; 2,915,722; 2,942,212; 3,090,934; 3,148,347; 3,441,888; 3,668,587 and 3,673,584. These transducers have been used in both position measuring systems, as exemplified by U.S. Pat. No. 3,191,010, and in conjunction with servo control systems to control the direction and speed of movement of a movable element, as exemplified by U.S. Pat. Nos. 3,839,665 and 3,954,163.

U.S. Pat. No. 3,191,010 discloses a phase-sensitive inductive transducer wherein a first input signal is applied to one of the windings of the first relatively movable member and a second input signal is applied to another of the windings of such member. An output signal is thus developed by induction on the winding of the second relatively movable member. Typically, the first and second input signals are sinusoidal in nature of substantially identical frequency and peak amplitude and are phase-displaced by a predetermined amount (e.g. 90°) since the two windings of the first relatively movable member are displaced in space phase by such predetermined amount (e.g. in space quadrature). Accordingly, then, the output signal induced on the winding of the second relatively movable member is substantially constant in peak amplitude and variable in phase during relative movement of the first and second relatively movable members. By appropriately demodulating this output signal, a position signal may be derived that is periodic in nature in response to relative movement.

Copending U.S. Application No. 670,463 filed on Mar. 25, 1976, now Patent No. 4,059,789 in the name of Kenneth W. Cocksedge and copending U.S. Application No. 737,972 filed in the names of James O. Jacques and Robert D. Carlson, both assigned to the assignee of the present invention, disclose phase-sensitive transducer apparatus of the type above-described as used in conjunction with servo control systems.

In most contemporary servo control systems utilizing a position signal as derived from an inductive transducer apparatus, movement of the controlled movable element is generally detected by sensing zero-crossings, or null points, of the position signal. In the case of a disc drive, for example, the null points can be used to define track crossings wherein one of the two relatively movable members is fixed and the other is connected to the carriage of a read/write head. It is important to derive a position signal that varies as linearly as possible in response to movement of the head relative to the tracks recorded on the disc surface for proper head positioning. Accordingly, it is desired that the induced output signal on the second relatively movable member change in phase as linearly as possible in response to relative movement.

Many prior art inductive transducers of the phase-sensitive type are sensitive to relative movements between the two relatively movable members in directions other than the requisite translational direction.

There are five degrees of relative movement other than the requisite translational movement, i.e. two other in translation and three in rotation. Relative motions occurring in any one or more of these five unwanted degrees might result in variances in the inductive coupling between the windings of the two relatively movable members. Such variances may cause an unwanted shift in the phase of the output signal which could destroy the desired linearity of phase change, as discussed above.

Capacitive coupling has traditionally presented a problem in inductive transducers. Capacitive coupling effects could alter the apparent inductive coupling between the windings of the two relatively movable members, if not properly compensated for. As indicated above, such alteration may cause an unwanted shift in the phase of the output signal, thereby destroying the linearity of a position signal derived therefrom.

It would be desirable, therefore, if the phase of the output signal from a phase-sensitive transducer could be substantially insensitive to relative movements in at least some of the five unwanted degrees of motion. It would further be desirable if the effects of capacitive coupling between the windings of the two relatively movable members could be minimized and/or compensated for in order to maintain a substantially linear relationship between the relative movement of the two relatively movable members and the change in phase of the output signal from the transducer.

SUMMARY OF THE INVENTION

In accordance with one aspect of the present invention, an inductive transducer is provided comprising first and second relatively movable member, the first relatively movable member having a plurality of windings and the second relatively movable member having a winding, at least one of the windings of the first relatively movable member having a pair of terminals and being arranged in a pattern comprised of a first section coupled to one of said terminals and a second section coupled to the other terminal and to the first section, each section including a plurality of conductors oriented substantially parallel to one another wherein immediately adjacent conductors of such section are capable of conducting current in opposite directions and are coupled to one another by an end-segment arranged substantially perpendicular to the conductors, each end-segment of the first section being spaced closely adjacent and substantially parallel to an end-segment of the second section, and each conductor of said first section being spaced closely adjacent and substantially parallel to a conductor of the second section adapted to conduct current in the opposite direction as such conductor of the first section.

In accordance with the preferred embodiment, the two terminals of the above-described at least one winding of the first relatively movable member are desirably driven by a balanced drive source, i.e. the signal applied across the two terminals is sinusoidal in nature wherein the potential at one terminal is always substantially equal, but opposite in polarity, to the potential at the other terminal. In this event, and in accordance with the present invention, the voltage level at any point along a conductor of the first section of the winding will be substantially equal, but opposite in polarity, to the voltage level at the most closely adjacent point of the juxtaposed conductor of the second section. The only exception is at the midpoint of the winding, i.e. the boundary of the first and second sections, where the voltage is at a constant reference potential, e.g. ground potential.

When a balanced drive source is used in the manner described-above, it will be appreciated that the unique configuration of the at least one winding of the first relatively movable member acts to substantially reduce the capacitive coupling between such winding and the winding of the second relatively movable member. In accordance with the preferred embodiment, each of the windings of the first relatively movable member has the unique configuration as above-described.

In accordance with another aspect of the present invention, an inductive transducer is provided comprising first and second relatively movable members, the first relatively movable member having a plurality of windings and the second relatively movable member having a winding, the winding of the second relatively movable member having a pair of terminals and being arranged in a pattern comprised of a first section coupled to one of the terminals and a second section coupled to the other terminal and to the first section, each section including a plurality of conductors oriented substantially parallel to one another wherein immediately adjacent conductors are adapted to conduct current in opposite directions and are coupled to one another by an end-segment arranged substantially perpendicular to the conductors, the first section having alternate end-segments thereof spaced closely adjacent and substantially parallel to alternate end-segments of the second section, and each conductor of the first section being substantially aligned longitudinally with a conductor of the second section adapted to conduct current in the same direction as such conductor of the first section.

By reason of this configuration of the winding of the second relatively movable member, it will be appreciated that whatever capacitive coupling does exist between such winding and the windings of the first relatively movable member or ground will be balanced with respect to the two terminals of such winding. If, then, the transducer output signal is applied through a differential amplifier included in a conventional amplifier and squarer circuit, as is the case with the phase-sensitive transducer apparatus disclosed in the above-referenced copending Application No. 670,463, any capacitive coupling effects, being balanced with respect to the two terminals of the second relatively movable member, would then be effectively cancelled out by the differential amplifier. As is conventional, the squared output signal from the amplifier and squarer circuit can be appropriately demodulated to derive a position signal having a linear relationship with the change in phase angle of the output signal.

In accordance with the preferred embodiment, each run of the pattern of the winding of the second relatively movable member i.e. the combined length of each pair of aligned conductors of the two sections is desirably less than the runs of the windings of the first relatively movable member. In this manner, the winding of the second relatively movable member may be centered with respect to and in the direction of the runs of the windings of the first relatively movable member such that no portion of the winding of the second relatively movable member will inductively couple only one winding or only the other winding of the first relatively movable member. This relationship renders the transducer relatively insensitive to slight movements perpendicular to and in the same plane as the desired translational movement.

These and other aspects and advantages of the present invention will be more completely described below with reference to the accompanying drawings.

DESCRIPTION OF THE PREFERRED EMBODIMENT

Figure 1:
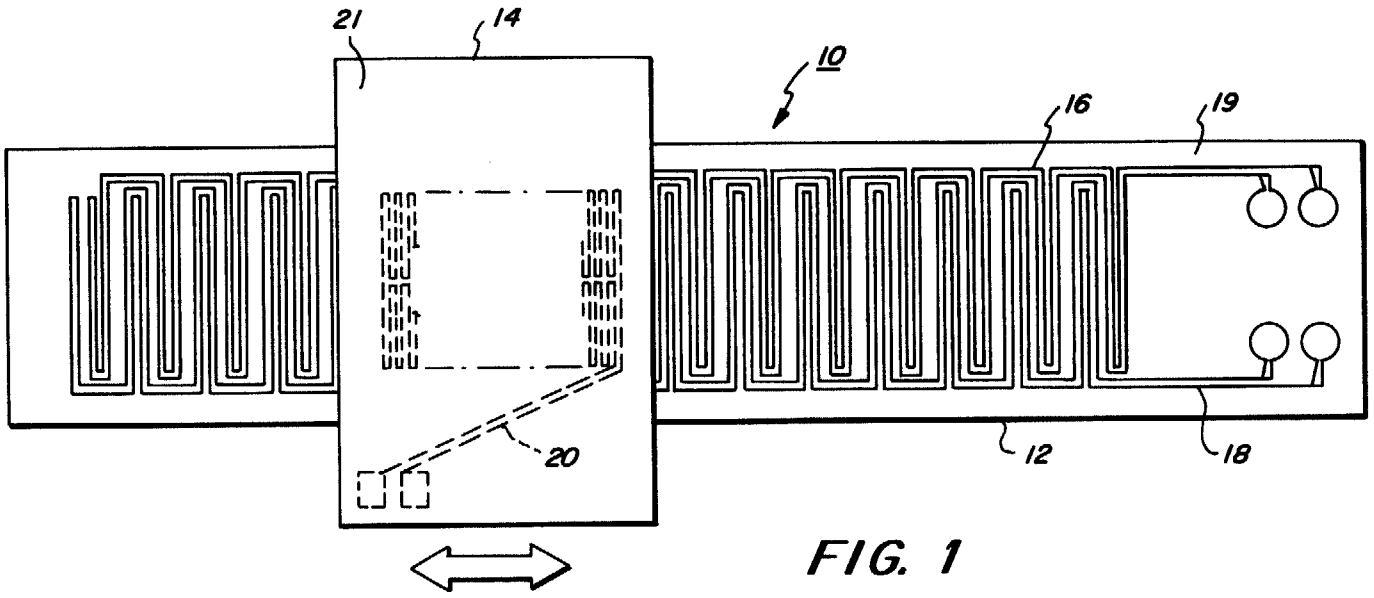
FIG. 1 is a side elevation view of an inductive transducer of the present invention.

Referring to FIG. 1, an inductive transducer 10 of the present invention is shown. The transducer 10 is comprised of a pair of relatively movable members 12 and 14. By way of example, the transducer 10 is shown as being of the lineartype wherein the relatively movable member 12 contains a pair of electrically conductive windings 16 and 18 formed on an insulative support plate 19, which may alternatively be a metallic plate having an insulative outer coating, as is conventional. The windings 16 and 18 may be formed by any suitable conventional technique. The member 12 may be mounted in a fixed position by suitable means (not shown). The relatively movable member 14 includes a support plate 21, preferably fabricated of the same material as plate 19 of member 12, and contains a single winding 20 formed thereon. The member 14 may be mounted by suitable means (not shown) for reciprocal translational movement relative to the member 12 along the longitudinal axis of the member 12, as is conventional. The relatively movable members 12 and 14 shall hereinafter be referred to respectively as the scale 12 and the slider 14, since these terms are standard with respect to linear-type inductive transducers.

Figure 2:
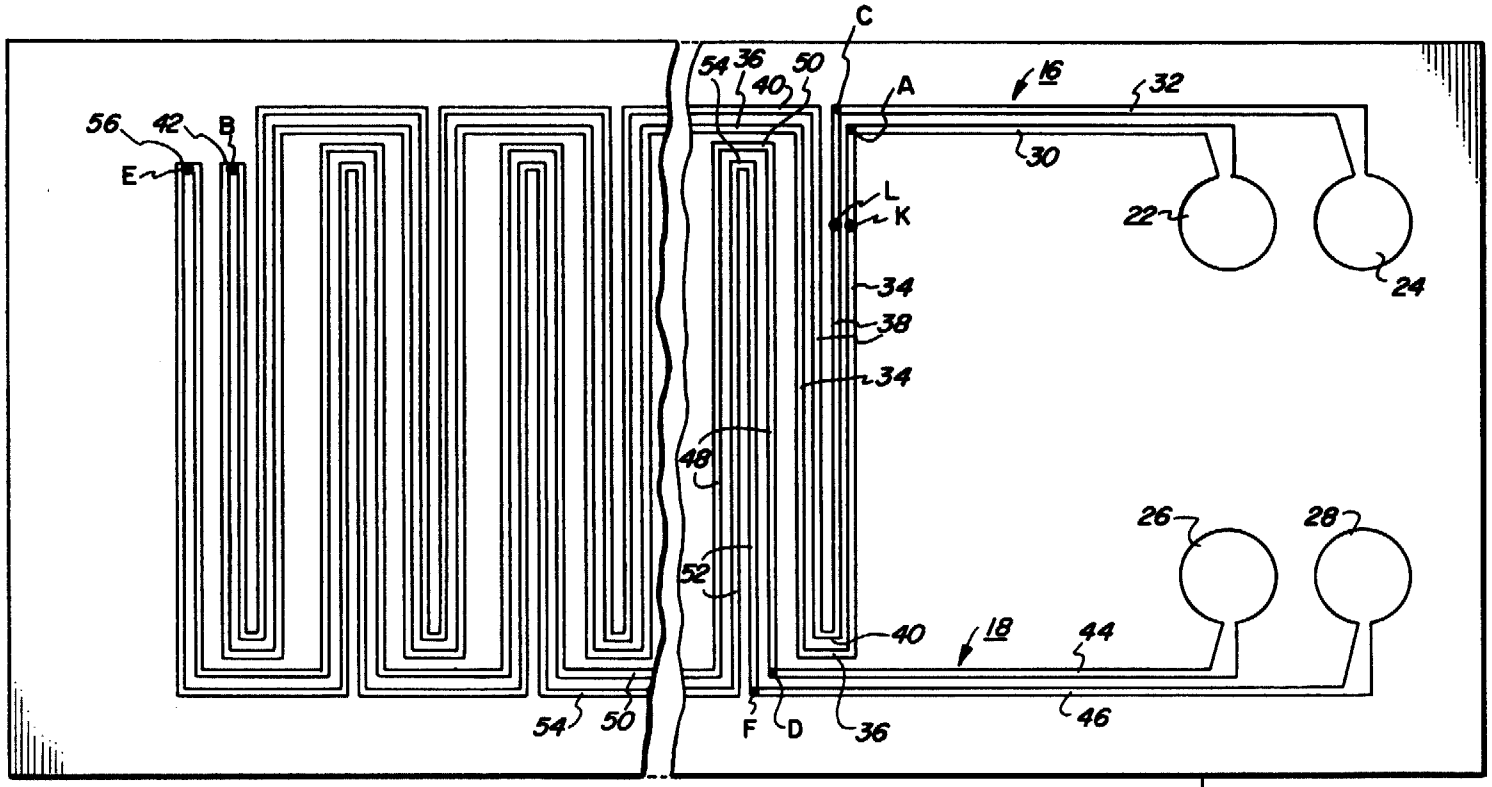
FIG. 2 is an elevation view of the active surface of a first member of the transducer of FIG. 1.

As best shown in FIG. 2, each of the windings 16 and 18 of the scale 12 has a pair of terminals 22 - 24 (winding 16) and 26 - 28 (winding 18). The winding 16 is arranged in a pattern comprised of a first section coupled to the terminal 22 and a second section coupled to the terminal 24 and to the first section. The first section, to be defined below, is coupled to the terminal 22 by a segment 30 of the winding arranged substantially parallel to the longitudinal axis of the scale 12. The first section of the pattern commences at a point A at one end of the segment 30, the other end of such segment being joined to the terminal 22, and terminates at a point B defined substantially at the midpoint of the pattern. Correspondingly, the second section is coupled to the terminal 24 by a segment 32 of the winding 16 preferably arranged substantially parallel to the segment 30. The second section of the pattern commences at the point B and terminates at a point C at one end of the segment 32, the other end of such segment being joined to the terminal 24.

As shown in FIG. 2, the first section of the pattern of winding 16, hereinafter referred to as section A–B, includes a plurality of conductors 34 oriented substantially parallel to one another wherein immediately adjacent conductors 34 are adapted to conduct current in opposite directions when a drive signal is applied at the terminals 22 and 24 of the winding 16. The nature of a preferred drive signal will be discussed in more detail below. Immediately adjacent conductors 34 are coupled to one another by an end-segment 36 of the winding. The end-segments 36 are preferably mutually parallel to one another and substantially perpendicular to the conductors 34.

The second section of the pattern of winding 16, hereinafter referred to as section B–C, also includes a plurality of conductors 38 oriented substantially parallel to another wherein immediately adjacent conductors 38 are adapted to conduct current in opposite directions when a drive signal is applied at the terminals 22 and 24. Immediately adjacent conductors 38 are coupled to one another by an end-segment 40 of the winding. As with the end-segments 36, the end-segments 40 are preferably mutually parallel to one another and substantially perpendicular to the conductors 38.

As shown in FIG. 2, each end-segment 36 of the section A–B is spaced closely adjacent in juxtaposition with and substantially parallel to a corresponding end-segment 40 of the section B–C. Further, each conductor 34 of the section A–B is spaced closely adjacent in juxtaposition with and substantially parallel to a corresponding conductor 38 of the section B–C adapted to conduct current in the opposite direction as such conductor 34 when a drive signal is applied at the terminals 22 and 24.

The above configuration of the pattern of winding 16 may thus be termed a "double bi-filar" winding wherein both sections A–B and B–C are mutually parallel along substantially their entire extents, except for a mid end-segment 42 connecting the two adjacent conductors 34 and 38 approximately at the middle of the winding 16, as shown in FIG. 2. The mid-point B lies substantially in the middle of segment 42.

Desirably, the length of the end-segments 36 connecting the lower ends of adjacent conductors 34 is substantially less than the length of the end-segments 40 connecting the upper ends of adjacent conductors 34. In the presently preferred embodiment, the length of the upper end-segments 36 is approximately about 70 mils, wherein the length of the lower end-segments 36 is approximately about 30 mils. Further, and in accordance with the preferred embodiment, the "pitch," or distance between recurring conductors 34 adapted to conduct current in the same direction, is approximately about 100 mils. Lastly, the spacing between the juxtaposed conductors 34 and 38, and the spacing between the juxtaposed end-segments 36 and 40, are both preferably approximately about 10 mils.

It should be noted that all dimensions set forth herein are to be considered measured from center-line to center-line. For example, the length of each end-segment 36 is measured between the center-lines of the two conductors 34 it connects.

Thus far, only the winding 16 has been described in detail. The winding 18 of scale 12 is virtually identical in configuration as winding 16, except that it is inverted and shifted in space-phase by 90°. In the preferred embodiment, such shift is approximately about 45 mils, i.e. 25 mils (one-quarter of the 100 mils pitch) plus 20 mils. The additional 20 mils shift is required in the case where the two windings are in the same plane, i.e. the preferred embodiment, so that such windings do not overlap one another. Nonetheless, the desired 90° phase-displacement is still achieved. It will be appreciated that the additional 20 mils shift would be unnessary in the case where multiple level coplanar windings are used.

Referring specifically to the winding 18 as shown in FIG. 2, it is arranged in a pattern comprised of a first section coupled to the terminal 26 and a second section coupled to the terminal 28 and to the first section. The first section, to be defined below, is coupled to the terminal 26 by a segment 44 of the winding arranged substantially parallel to the longitudinal axis of the scale 12. The first section of the pattern commences at a point D at one end of the segment 44, the other end of such segment being joined to the terminal 26, and terminates at a point E defined substantially at the midpoint of the pattern. Correspondingly, the second section is coupled to the terminal 28 by a segment 46 of the winding 18 preferably arranged substantially parallel to the segment 44. The second section of the pattern commences at the point E and terminates at a point F at one end of the segment 46, the other end of such segment being joined to the terminal 28.

As shown in FIG. 2, the first section of the pattern of winding 18, hereinafter referred to as section D–E, includes a plurality of conductors 48 oriented substantially parallel to one another and to the conductors 34 and 38 of winding 16, wherein immediately adjacent conductors 48 are adapted to conduct current in opposite directions when a drive signal is applied at the terminals 26 and 28. Again, the nature of a preferred drive signal will be discussed in more detail below. Immediately adjacent conductors 48 are coupled to one another by an end-segment 50 of the winding. The end segments 50 are preferably mutually parallel to one another and substantially perpendicular to the conductors 48.

The second section of the pattern of winding 18, hereinafter referred to as section E–F, also includes a plurality of conductors 52 oriented substantially parallel to one another wherein immediately adjacent conductors 52 are adapted to conduct current in opposite directions when a drive signal is applied at the terminals 26 and 28. Immediately adjacent conductors 52 are coupled to one another by an end-segment 54 of the winding 18. As with the end-segments 50, the end-segments 54 are preferably mutually parallel to one another and substantially perpendicular to the conductors 52.

As shown in FIG. 2, each end-segment 50 of the section D–E is spaced closely adjacent in juxtaposition with and substantially parallel to a corresponding end-segment 54 of the section E–F. Further, each conductor 48 of the section D–E is spaced closely adjacent in juxtaposition with and substantially parallel to a corresponding conductor 52 of the section E–F adapted to conduct current in the opposite direction as such conductor 48 when a drive signal is applied at the terminals 26 and 28.

The configuration of the pattern of winding 18 may thus also be termed a double bi-filar winding, wherein both sections D–F and E–F are mutually parallel along substantially their entire extents, except for a mid end-segment 56 connecting the two adjacent conductors 48 and 52 approximately at the middle of the winding 18, as shown in FIG. 2. The mid-point E lies substantially in the middle of segment 56.

Since the patterns of windings 16 and 18 are desirably identical, but inverted and offset in space-phase, preferably in space-quadrature, as mentioned above, the length of the end-segments 50 joining the upper ends of adjacent conductors 48 is substantially equal to the length of the end-segments 36 joining the lower ends of adjacent conductors 34. Corresponding, the length of the end-segments 50 joining the lower ends of adjacent conductors 48 is substantially equal to the length of the end-segments 40 joining the upper ends of adjacent conductors 34. The same relationship is true between the length of end-segments 50 and 54 of the winding 18.

In a preferred embodiment, the spacing between each end-segment 50 of winding 18 and the closest adjacent end-segment 36 of winding 16 is approximately about 10 mils. Further, the desired spacing between each conductor 48 and the closest adjacent conductor 34 in the direction of the terminals 22–28 is approximately about 15 mils. Lastly, the desired spacing between each conductor 48 and the closest adjacent conductor 34 in a direction opposite the terminals 22–28 is approximately about 25 mils.

Before describing the benefits of the double bi-filar configurations of the windings 16 and 18 of scale 12, as well as the inductive interaction thereof with the winding 20 of the slider 14, the precise configuration of the slider 14 will be described in detail.

Figure 3:
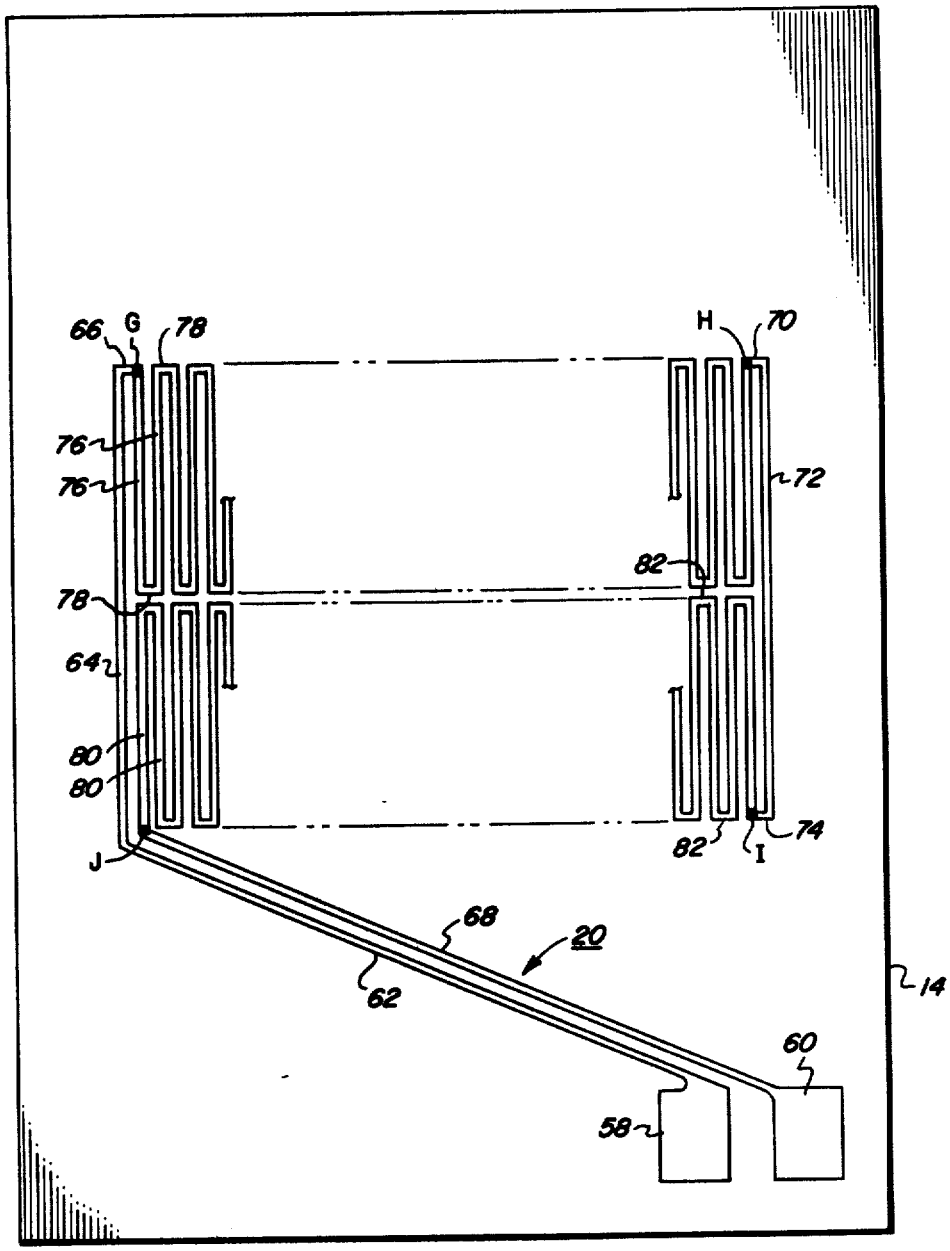
FIG. 3 is an elevation view of the active surface of a second member of the transducer of FIG. 1.

Referring to FIG. 3, the winding 20 of slider 14 has a pair of terminals 58 and 60 and is arranged in a pattern comprised of a first section coupled to the terminal 58 and a second section coupled to the terminal 60 and to the first section. The first section, to be defined below, is coupled to the terminal 58 by a series of three segments 62, 64 and 66 of the winding 20. The segment 62 is preferably arranged oblique to the longitudinal axis of the slider 14, the segment 64 parallel to such axis, and the segment 66 perpendicular to such axis. The first section of the pattern commences at a point G at one end of the segment 66, the other end of such segment being joined to the terminal 58 by segments 64 and 62, and terminates at a point H. Correspondingly, the section section is coupled to the terminal 60 by a segment 68 of the winding 20 arranged substantially parallel to and closely adjacent the segment 62. The second section of the pattern commences at a point I and terminates at a point J coupled to one end of the segment 68, the other end of such segment being connected to the terminal 60. Three serial segments 70, 72 and 74 connect the point H on the first section, hereinafter referred to as section G–H, with the point I on the second section, hereinafter referred to as section I–J. The segments 70 and 74 are preferably parallel to one another and perpendicular to the longitudinal axis of the slider 14, whereas the segment 72 is desirably parallel to such longitudinal axis.

As shown in FIG. 3, the section G–H includes a plurality of conductors 76 oriented substantially parallel to one another and to the segments 64 and 72, wherein immediately adjacent conductors 76 are adapted to conduct current in opposite directions when a signal is induced on the winding 20 from the windings 16 and 18 of scale 12 in a manner to be described in more detail below. Immediately adjacent conductors 76 are coupled to one another by an end-segment 78 of the winding 20. The end-segments 78 are preferably all parallel to one another and to the segments 66, 70 and 74.

The section I–J of the pattern of winding 20 also includes a plurality of conductors 80 oriented substantially parallel to one another and to the segments 64 and 72, wherein immediately adjacent conductors 80 are adapted to conduct current in opposite directions when a signal is induced on the winding 20 from the windings 16 and 18 of the scale 12. Immediately adjacent conductors 80 are coupled to one another by an end-segment 82 of the winding 20. The end-segments 82 are preferably all parallel to one another and to the end-segments 78 of the section G–H. Further, and in accordance with the present invention, the section G–H has alternate end-segments 78 thereof spaced closely adjacent in juxtaposition with and parallel to alternate end-segments 82 of the section I–J, wherein each conductor 76 of section G–H is substantially alinged longitudinally with a conductor 80 of section I–J adapted to conduct current in the same direction as such conductor 76 when a signal is induced on the winding 20.

In accordance with the presently preferred embodiment, the length of each segment 66, 70, 74 and end-segments 78 and 82 are substantially identical and desirably approximately equal to about 10 mils. Accordingly, the spacing between immediately adjacent conductors 76 of section G–H and between immediately adjacent conductors 80 of section I–J are both approximately about 10 mils. Also, the spacing between juxtaposed end-segments 78 and 82 is desirably approximately about 10 mils.

Referring again to FIG. 1, the scale 12 and slider 14 are preferably oriented parallel to one another with a spacing there between suitable to enable a signal induced on the winding of the slider 20 to be at a desired peak amplitude. In this respect, the transducer 10 has been described as a phase-sensitive transducer, where the output is derived from the single winding member, i.e. slider 14. As is conventional, a pair of phase-displaced sinusoidal signals (not shown) may be respectively applied to the windings 16 and 18 of the scale. These signals generally have the same peak amplitude and frequency, but are phase-shifted by the same amount that the windings 16 and 18 are displaced in space phase by. In the preferred embodiment above-described, therefore, the two sinusoidal signals would be 90° out-of-phase.

The output signal developed by induction on the winding 20 of the slider 14 will be substantially constant in peak amplitude and frequency, but variable in phase as the slider 14 is moved relative to the scale 12. Specifically, when the conductors 76 and 80 of the winding 20 are aligned with the conductors 34 and 38 of the winding 16, the phase angle of the output signal induced on the winding 20 will be the same as that of the sinusoidal signal applied to the winding 16. As the slider is moved in one direction relative to the scale, this phase angle will change substantially linearly in response to such movement, wherein when the conductors 76 and 80 are aligned with the conductors 48 and 52 of the winding 18, the phase angle would have shifted by 90°. This general concept is more completely described in the aforementioned U.S. Pat. No. 3,191,010, as well as other ones of the above-referenced patents and copending applications.

The double bi-filar arrangement of the windings 16 and 18 of the scale 12 contribute to a substantial reduction in capacitive coupling between such windings and the winding 20, thereby lessening the chances of such coupling adversly effecting the inductive coupling between such windings. As indicated above, unwanted changes in the apparent inductive coupling can cause a shift in the phase angle of the output signal leading to errors in any position signal that may be derived therefrom. The desired reduction in capacitive coupling maybe noted when the windings 16 and 18 are each driven by a balanced drive source (not shown), which may be of any well known conventional type.

When using balanced drivers, the potential present at the terminal 22 will be equal, but opposite (180° out-of-phase in the case of sinusoidal input) to the potential present at terminal 24. Correspondingly, the potential present at terminal 26 will be equal, but opposite, to the potential present at terminal 28. With this the case, it will be appreciated that at any point K along a conductor 34, for example, the potential thereat at any point of time will be equal, but opposite, to the potential at the most closely adjacent point L of the juxtaposed conductor 38. Accordingly, due to the relatively small spacing (preferably about 10 mils) between adjacent conductors 34 and 38 of the winding 16 and between adjacent conductors 48 and 52 of the winding 18, as well as between adjacent conductors 76 and adjacent conductors 80 of the winding 20, and the spacing between segments 64 and 72 and their respective adjacent conductors 76 and 80, it will be apparent that whatever capacitive coupling exists between a conductor 34 or 48 and the winding 20 will be substantially compensated for the equal, but opposite, potential in the adjacent conductor 38 or 52, respectively.

The unique configuration of the slider winding 20 as above described also contributes to a reduction in capacitive coupling. More specifically, in the case of a phase-sensitive transducer, the sinusoidal phase-variable output signal developed across the terminals 58 and 60 of the winding 20 may be used to derive a position signal that varies linearly in response to the linear phase change of the output signal caused by relative movement of the slider 14 and scale 12. The abovementioned copending Application No. 670,463 specifically describes a phase-sensitive transducer apparatus for generating such a position signal which, in that application, is depicted as either a triangular wave or a saw-tooth wave.

In accordance with the method and apparatus for developing such a position signal, the output signal from the slider 14 (or rotor in the case of a rotary transducer) is applied through a conventional amplifier and squarer circuit. An exemplary amplifier and squarer circuit is depicted in Application No. 670,463. As is conventional, such amplifier and squarer circuit includes a differential amplifier having two inputs to which the terminals 58 and 60 of the slider winding 20 may, and would normally, be connected. Additional components in the amplifier and squarer circuit act upon the output of the differential amplifier to generate a "squared up" version of the output signal from the slider winding.

Now then, it will be appreciated that whatever capacitive coupling is present between the conductors 76 of section G–H of winding 20 and the scale windings 16 and 18 or ground will be substantially equally present with respect to the conductors 80 of section I–J, due to the arrangement of the pattern of winding 20, as described above. Accordingly, when the terminals 58 and 60 are coupled to a differential amplifier of the type included in the conventional amplifier and squarer circuit disclosed in Application No. 670,463, it will be evident that the capacitive coupling effects, being substantially balanced with respect to both sections G–H and I–J of the slider winding 20, will be effectively cancelled out in the differential amplifier and thus will have no effect on the ultimate position signal that may be generated.

As another feature of the present invention, it will be noted, with reference to FIG. 1, that the slider winding 20 is approximately centered with respect to the scale windings 16 and 18 in a direction parallel to the conductors 34, 38, 48 and 52 such that no portion of the slider winding 20 will see only conductors 34 and 38 of the winding 16 or only conductors 48 and 52 of the winding 18. More specifically, it may be said that the "runs" of the slider winding 20, i.e. the combined length of each pair of aligned conductors 76 and 80, is shorter than and generally centered with respect to the "runs" of the scale windings, as defined by the conductors 34, 38, 48 and 52. Accordingly, any slight movements in directions perpendicular to and in the same plane with the desired direction of translational movement of the slider 14, i.e. parallel to the longitudinal axis of the scale 12, will not significantly change the inductive coupling between the scale windings 16 and 18 and the slider winding 20. Consequently, the desired linearily of phase angle change of the output signal developed across the terminals 58–60 of winding 20 will not be adversely affected.

It will be appreciated that any slight rotational movements of the slider 14 about its center in a plane parallel to the scale 12 will be inherently compensated for. Specifically, the amount of translational shift of each conductor 76 of winding 20 in one direction relative to the scale windings 16 and 18 will be offset by a like translational shift of each conductor 80 in the opposite direction. Consequently, even though the overall inductive coupling, and thus the amplitude of the output signal, may be reduced, yet the phase angle thereof will not be adversly affected by such slight movements. Similarly, slight relative movements of the slider 14 and scale 12 in directions perpendicular to a plane parallel to the slider and scale will affect the inductive coupling in a balanced manner with respect to the terminals 58–60 of the winding 20 such that the phase angle of the output signal will not be adversly shifted by such relative movements. Lastly, slight rotational movements of the slider 14 about a line intersecting its center and parallel to the longitudinal axis of the scale will not significantly affect the phase angle of the output signal since there is no relative movement between the slider 14 and scale 12 in the desired translational direction (see arrows - FIG. 1).

Although the present invention has been described with respect to a presently preferred embodiment, it will be appreciated that various modifications, substitutions, etc. may be made without departing from the spirit and scope of the invention as defined in and by the following claims. For example, although a linear transducer has been shown and described, the invention could also be applied to a rotary transducer wherein the two windings 16 and 18 would be formed on a stator and the winding 20 on a rotor. Further, the unique windings of the two relatively movable members could be used in the context of an amplitude-sensitive transducer of the type disclosed in U.S. Pat. Nos. 3,839,665 and 3,954,163. In such a transducer, a sinusoidal carrier wave would be applied to the single winding member and a pair of modulated phase-displaced signals would be developed on the pair of windings of the dual winding member. Also, it will be appreciated that the use of a scale having only two windings is merely exemplary, as more than two mutually phase-displaced windings could be employed. Further, and as pointed out above, the windings of the scale could be in different planes. Still further, the use of balanced drive sources, although definitely preferred, it not essential.

What is claimed is:

1. An inductive transducer comprising:

first and second relatively movable members, said first relatively movable member having a plurality of windings and said second relatively movable member having a winding;

each of the windings of said first relatively movable member having a pair of terminals and being arranged in a pattern comprised of a first section coupled to one of said terminals and a second section coupled to the other terminal and to said first section, each section including a plurality of conductors oriented substantially parallel to one another wherein immediately adjacent conductors of such section are capable of conducting current in opposite directions and are coupled to one another by an end-segment arranged substantially perpendicular to said conductors, each end-segment of said first section being spaced closely adjacent and substantially parallel to an end-segment of said second section, and each conductor of said first section being spaced closely adjacent and substantially parallel to a conductor of said second section adapted to conduct current in the opposite direction as such conductor of said first section; and the winding of said second relatively movable member having a pair of terminals and being arranged in a pattern comprised of a first section coupled to one of said terminals and a second section coupled to the other terminal and to said first section, each section including a plurality of conductors oriented substantially parallel to one another wherein immediately adjacent conductors are adapted to conduct current in opposite directions and are coupled to one another by an end-segment arranged substantially perpendicular to said conductors, said first section having alternate end-segments thereof spaced closely adjacent and substantially parallel to alternate end-segments of said second section, and each conductor of said first section being substantially aligned longitudinally with a conductor of said second section adapted to conduct current in the same direction as such conductor of said first section.

2. The inductive transducer of claim 1, wherein said first and second relatively movable members are mounted relative to one another such that the conductors of said first relatively movable member windings are substantially parallel to the conductors of said second relatively movable member winding.

3. The inductive transducer of claim 1, wherein said first and second relatively movable members are mounted relative to one another such that the end-segments of said first relatively movable member windings are substantially parallel to the end-segments of said second relatively movable member winding.

4. The inductive transducer of claim 2, wherein the end-segments of said first relatively movable member windings are substantially parallel to the end-segments of said second relatively movable member winding.

5. The inductive transducer of claim 4, wherein the pitch of each section of the pattern of each winding of said first relatively movable member is approximately about 100 mils.

6. The inductive transducer of claim 5, wherein the pitch of each section of the pattern of the winding of said second relatively movable member is approximately about 20 mils.

7. The inductive transducer of claim 1, wherein said first relatively movable member has a pair of windings which are shifted in space-phase from one another by a predetermined amount.

8. The inductive transducer of claim 7, wherein said predetermined amount is approximately about 90°.

9. The inductive transducer of claim 6, wherein said first relatively movable member has a pair of windings, the pattern of each of said pair of windings being substantially identical to one another, but inverted and shifted by approximately about 25 mils relative to one another, whereby said pair of windings are displaced in space quadrature from one another.

10. The inductive transducer of claim 1, wherein the runs of the pattern of the winding of said second relatively movable member are shorter than and generally centered with respect to the runs of the patterns of the windings of said first relatively movable member.

11. The inductive transducer of claim 9, wherein the runs of the pattern of the winding of said second relatively movable member are shorter than and generally centered with respect to the runs of the patterns of the pair of windings of said first relatively movable member.

12. The inductive transducer of claim 1, wherein the windings of said first relatively movable member are coplanar.

13. The inductive transducer of claim 1, wherein the winding of said second relatively movable member is in a plane parallel to the windings of said first relatively movable member.

14. The inductive transducer of claim 13, wherein the windings of said first relatively movable member are coplanar.

* * * * *